US012449158B2

(12) United States Patent
Kim et al.

(10) Patent No.: US 12,449,158 B2
(45) Date of Patent: Oct. 21, 2025

(54) INDOOR UNIT OF AIR CONDITIONER

(71) Applicant: LG ELECTRONICS INC., Seoul (KR)

(72) Inventors: Kidong Kim, Seoul (KR); Seokho Choi, Seoul (KR); Sunghyun Nam, Seoul (KR); Hakjae Kim, Seoul (KR); Pyo Sagong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 456 days.

(21) Appl. No.: 18/008,806

(22) PCT Filed: Jun. 9, 2021

(86) PCT No.: PCT/KR2021/007212
§ 371 (c)(1),
(2) Date: Dec. 7, 2022

(87) PCT Pub. No.: WO2021/251751
PCT Pub. Date: Dec. 16, 2021

(65) Prior Publication Data

US 2023/0204251 A1 Jun. 29, 2023

(30) Foreign Application Priority Data

Jun. 11, 2020 (KR) ..... 10-2020-0071128

(51) Int. Cl.
*F24F 13/14* (2006.01)

(52) U.S. Cl.
CPC ..... *F24F 13/1413* (2013.01); *F24F 13/1426* (2013.01); *F24F 2013/1433* (2013.01)

(58) Field of Classification Search
CPC ..... F24F 13/1413; F24F 13/1426; F24F 2013/1433; F24F 2013/1473; F24F 1/0011; F24F 1/0057; F24F 13/08
See application file for complete search history.

(56) References Cited

U.S. PATENT DOCUMENTS 5,624,313 A * 4/1997 Nonaka ..... F24F 13/075 454/319
2014/0199937 A1* 7/2014 Shang ..... F24F 13/10 454/307

(Continued)

FOREIGN PATENT DOCUMENTS

JP 10-19300 1/1998
JP 2003-294303 10/2003

(Continued)

OTHER PUBLICATIONS

European Search Report issued in Application No. 21821354.4 dated May 3, 2024.

(Continued)

*Primary Examiner* — Edelmira Bosques
*Assistant Examiner* — Michael James Giordano
(74) *Attorney, Agent, or Firm* — KED & ASSOCIATES

(57) ABSTRACT

An indoor unit of an air conditioner, the indoor unit including a case having an outlet elongated in one direction; a first vane disposed at the outlet; a second vane disposed at the outlet at a position behind the first vane; a drive motor disposed on one side of the outlet and configured to provide a driving force to at least one of the first vane or the second vane; a drive link coupled to a shaft of the drive motor, and having a first end connected to the first vane and a second end connected to the second vane; and a first vane link having a first end connected to the case and a second end connected to an end portion in a longitudinal direction of the first vane. The first vane has a first curvature formed on a surface perpendicular to an air discharge direction and formed in the longitudinal direction, such that the outlet may be tightly closed in response to sagging of a central part of the first vane due to self-weight in a dual vane structure, and (Continued)

in response to torsion that occurs due to a third vane link provided in the dual vane structure.

18 Claims, 12 Drawing Sheets

(56) References Cited

U.S. PATENT DOCUMENTS

| | | | |
|---|---|---|---|
| 2015/0253032 | A1 | 9/2015 | Kono et al. |
| 2020/0063983 | A1 | 2/2020 | Iwase et al. |

FOREIGN PATENT DOCUMENTS

| | | | | | |
|---|---|---|---|---|---|
| JP | 2003-329295 | | | 11/2003 | |
| KR | 10-2018-0089784 | | | 8/2018 | |
| KR | 10-2019-0027335 | | | 3/2019 | |
| KR | 10-2019-0048077 | | | 5/2019 | |
| KR | 20190048077 | A | * | 5/2019 | |
| KR | 10-2019-0115566 | | | 10/2019 | |
| WO | WO-2020052482 | A1 | * | 3/2020 | ..... F24F 1/0022 |

OTHER PUBLICATIONS

International Search Report (with English Translation) dated Oct. 8, 2021 issued in Application No. PCT/KR2021/007212.
Korean Office Action issued in Application No. 10-2020-0071128 dated Jan. 14, 2025.

* cited by examiner

INDOOR UNIT OF AIR CONDITIONER

CROSS-REFERENCE TO RELATED PATENT APPLICATIONS

This application is a U.S. National Stage Application under 35 U.S.C. § 371 of PCT Application No. PCT/KR2021/007212, filed Jun. 9, 2021, which claims priority to Korean Patent Application No. 10-2020-0071128, filed Jun. 11, 2020, whose entire disclosures are hereby incorporated by reference.

TECHNICAL FIELD

The following description relates to an indoor unit of an air conditioner, and more particularly to an indoor unit of an air conditioner which is installed indoors.

BACKGROUND ART

Generally, an air conditioner includes a compressor, a condenser, an evaporator, and an expander, and supplies cooled or heated air into a room using an air conditioning cycle.

The structure of the air conditioner is classified into a separated type in which a compressor is disposed outside, and an integrated type in which a compressor is integrated.

The separated-type air conditioner includes an indoor heat exchanger installed in an indoor unit and an outdoor heat exchanger and a compressor installed in an outdoor unit, in which the two separated units are connected via a refrigerant pipe.

In the integrated-type air conditioner, an indoor heat exchanger, an outdoor heat exchanger, and a compressor are installed in a single case. The integrated-type air conditioner includes a window-mounted air conditioner mounted in a window or a duct-mounted air conditioner mounted outside by connecting an intake duct and a discharge duct.

The separated-type air conditioner is generally classified according to the type of installation of the indoor unit.

An air conditioner with an indoor unit mounted vertically in an indoor space is called a stand-alone air conditioner, an air conditioner with an indoor unit mounted on the ceiling is called a ceiling-mounted air conditioner, and an air conditioner with an indoor unit mounted on the wall is called a wall-mounted air conditioner.

The wall-mounted air conditioner includes a case hung on the wall, and the case has an inlet through which air is drawn and an outlet through which air is discharged, and a discharge vane is disposed at the outlet. The wall-mounted air conditioner is mounted on one side wall and sends air by discharging the air to the other side. The wall-mounted air conditioner may include a vane and may discharge air in various directions by moving the vane.

In a related art, a vane is provided at the outlet of the wall-mounted air conditioner. The outlet is elongated in one direction, and the vane is elongated in one direction corresponding to the outlet. Rotating shafts are disposed at both ends in a longitudinal direction of the vane, and the vane rotates along with the rotating shaft.

In the related art, the vane guides the discharged air when an electric current is applied and closes the outlet when no electric current is applied. The vane is formed in a plate shape and is disposed perpendicular to the outlet to cover all directions of the outlet when no electric current is applied.

Accordingly, the vane may prevent dust or foreign matter from entering into the outlet when no electric current is applied.

However, the vane is formed in a long plate shape, such that a central part may sag due to self-weight. If the vane sags due to self-weight, the vane may not tightly close the outlet when no electric current is applied. Accordingly, a problem occurs in that foreign matter may enter into the air conditioner, causing dew condensation or exposure to bacterial infection.

In another related art, in order to solve the above problem, an auxiliary link is further provided at the center of the vane to prevent sagging due to self-weight. The auxiliary link has a structure in which one side thereof is fixed to the case and the other side thereof is hingedly coupled to the vane, such that when the vane is rotated by a driving force of a motor, the auxiliary link supports the vane at the center of the vane.

However, the auxiliary link may not be driven by itself, and the auxiliary link acts as resistance during rotation of the vane. If frictional force exists at a connection portion with the auxiliary link, displacement resulting from rotation on the auxiliary link side is less than displacement resulting from the rotation on a driving unit side, such that torsion occurs. Accordingly, the outlet may not be tightly closed when no electric current is applied, and foreign matter may enter into the air conditioner, causing dew condensation or exposure to bacterial infection.

Further, in another related art, an air conditioner is disclosed in which a width of a vane increases in order to improve performance of the vane. The related art provides a plurality of vanes for efficient use of space. A first vane and a second vane are driven in conjunction with each other, and when an electric current is applied, the first vane moves further forward than the second vane, such that the first vane and the second vane are disposed in a front-rear direction.

However, the first vane performs combined rotational and translational motion, such that when an auxiliary link structure is applied, the auxiliary link should be movably coupled unlike the aforementioned related arts. As a result, a problem occurs in that a difference in displacement between the auxiliary link side and the driving unit side increases more, thereby further increasing torsion of the first vane.

DISCLOSURE OF INVENTION

Technical Problem

It is an objective of the present disclosure to provide an indoor unit of an air conditioner with a dual vane structure in which a vane may tightly close an outlet when no electric current is applied, in response to torsion occurring due to an auxiliary link provided at the center of the vane.

It is another objective of the present disclosure to provide an indoor unit of an air conditioner in which a vane may tightly closing an outlet when no electric current is applied, in response to sagging due to self-weight.

The objectives of the present disclosure are not limited to the aforementioned objectives and other objectives not described herein will be clearly understood by those skilled in the art from the following description.

Technical Solution

An indoor unit of an air conditioner according to an embodiment of the present disclosure includes: a case having an outlet elongated in one direction; a first vane disposed at the outlet; a second vane disposed at the outlet at a position behind the first vane; a drive motor disposed on one side of the outlet and configured to provide a driving force to at least one of the first vane or the second vane; a drive link coupled to a shaft of the drive motor, and having a first end connected to the first vane and a second end connected to the second vane; and a first vane link having a first end connected to the case and a second end connected to an end portion in a longitudinal direction of the first vane, wherein the first vane has a first curvature formed on a surface perpendicular to an air discharge direction and formed in the longitudinal direction.

The first curvature may be concave in an air discharge direction when the first vane closes the outlet.

The first curvature may be formed at a rear end of the first vane, wherein the first vane may further have a second curvature with a radius of curvature different from a radius of curvature of the first curvature.

The first vane may further have a third curvature formed in a direction intersecting a direction in which the first curvature is formed.

The indoor unit of the air conditioner may further include a third vane link having a first end connected to the case and a second end connected to the first vane, and located further inward than the first vane link.

In addition, an indoor unit of an air conditioner according to an embodiment of the present disclosure includes: a case having an outlet extending in a first direction; a first vane disposed at the outlet and extending in the first direction; a second vane disposed at the outlet at a position behind the first vane; a drive motor disposed on one side of the outlet and configured to provide a driving force to at least one of the first vane or the second vane; a drive link coupled to a shaft of the drive motor, and having a first end connected to the first vane and a second end connected to the second vane; and a first vane link having a first end connected to the case and a second end connected to an end portion in the first direction of the first vane, wherein the first vane has a first curvature formed in the first direction.

Other detailed matters of the exemplary embodiments are included in the detailed description and the drawings.

Advantageous Effects of Invention

An indoor unit of an air conditioner according to the present disclosure has one or more of the following effects.

First, a first vane in a dual vane structure has a first curvature which is concave in an air discharge direction when the first vane closes the outlet, such that even when the first vane is deformed by sagging due to self-weight, the outlet may be tightly closed.

Second, the first vane has the first curvature which is concave in the air discharge direction when the first vane closes the outlet, such even when the first vane is deformed by torsion that occurs at a central part of the first vane due to a third vane link provided at the central part of the first vane, the outlet may be tightly closed.

Third, the first vane having the first curvature may be resistant to the sagging or torsion.

Fourth, the first vane has a first curvature formed at a front end and a second curvature formed at a rear end, such that even when the third vane link is biased to a rear portion of the first vane, the outlet may be tightly closed.

Fifth, as the first vane tightly closes the outlet when no electric current is applied, it is possible to set a wider rotation range of the dual vanes when an electric current is applied.

The effects of the present disclosure are not limited to the aforesaid, and other effects not described herein will be clearly understood by those skilled in the art from the following description of the appended claims.

MODE FOR THE INVENTION

Advantages and features of the present disclosure and methods for achieving the same become apparent from the embodiments described below in conjunction with the accompanying drawings. However, the present disclosure is not limited to the embodiments described below, and may be embodied in various forms. The embodiments are provided merely to make the present disclosure fully disclosed and to completely inform those skilled in the art of the category of the invention. The present disclosure is defined only by the appended claims. The same reference denotations refer to the same component throughout the specification.

The present disclosure will be described in detail with reference to the accompanying drawings.

Figure 1:
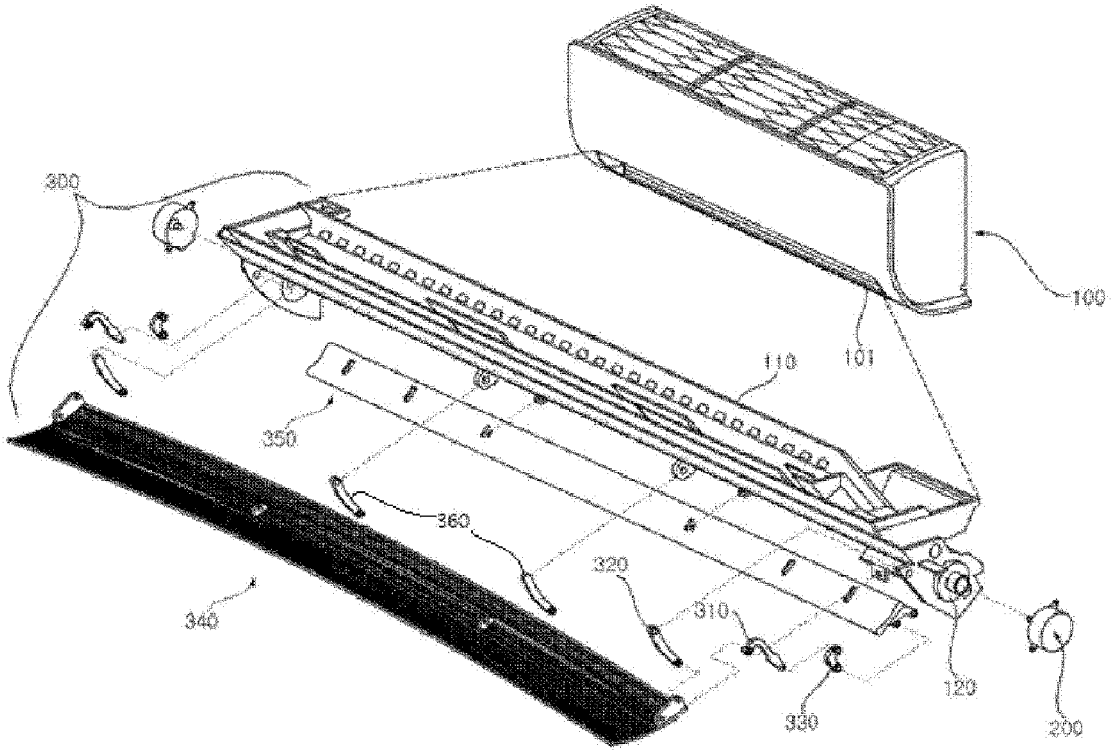
FIG. 1 is an exploded perspective view of a coupling state between an outlet and dual vanes of an indoor unit.

Referring to FIG. 1, an indoor unit of an air conditioner includes a case 100, a heat exchanger (not shown), a blower fan (not shown), and a vane module 300.

The case 100 includes an inlet (not shown) and an outlet 101. After air is drawn through the inlet (not shown), the air passes through an internal air flow path to be discharged through the outlet 101. The air drawn through the inlet (not shown) passes through the heat exchanger (not shown) disposed in the case 100. The heat exchanger (not shown) cools or heats the air by performing heat exchange with air flowing in the case 100 by heat transfer. The blower fan (not shown) draws in air and causes the air to flow therein, and provides a blowing force for discharging air cooled or heated by passing through the heat exchanger (not shown).

An indoor unit of an air conditioner according to an embodiment of the present disclosure may be an indoor unit of a wall-mounted air conditioner including a case 100 and hung on the wall. In this case, the inlet (not shown) may be disposed at an upper side of the case 100. In addition, the outlet 101 may be disposed at a front or lower side of the case 100. A plurality of inlets (not shown) and outlets 101 may be provided. In this case, the case 100 may have a rectangular shape which is elongated from side to side when viewed from the front.

Referring to FIG. 1, the outlet 101 according to the present disclosure may be provided with a vane for guiding a discharge flow of discharge air. The vane may be disposed inside the outlet 101 or may extend from the inside to the outside of the outlet 101, or may be disposed outside the outlet 101. In addition, when the indoor unit is not in operation, the vane may be disposed to cover the outlet 101.

The outlet 101 according to the present disclosure may be an open portion having a generally rectangular shape which is elongated from side to side. In this case, when the vane is disposed inside the outlet 101 or extends from the inside to the outside of the outlet 101, a width of the vane may be smaller than or equal to a width of the outlet 101 with respect to each longitudinal direction thereof. However, when the vane is disposed outside of the outlet 101, a longitudinal width of the vane may be greater than a longitudinal width of the outlet 101.

The longitudinal direction of the outlet 101 may be defined as a first direction.

A plurality of vanes according to the present disclosure may be provided. In the case where the plurality of vanes are disposed, the vanes may be disposed inside the outlet 101, may extend from the inside to the outside of the outlet 101 or may be disposed outside of the outlet in the same manner or in different manners. In addition, the respective vanes may be different in width or breadth.

The vanes according to the present disclosure may be two in number. In an embodiment of the present disclosure, when two vanes are disposed as described above, the two vanes will be defined as dual vanes. In this case, one vane may have a greater width or breadth in the longitudinal direction than the other one. The two vanes may be sequentially disposed in a front-rear direction with respect to an air discharge direction of the outlet 101. In this case, one vane is a main vane, and the other one may be an auxiliary vane. In this case, both or each of the one vane and the other vane may rotate. Further, the center of gravity of both or each of the one vane and the other vane may be moved. The two vanes may be controlled to rotate or move independently of each other or may be controlled to rotate or move dependently with each other. In this case, the one vane may be a first vane 340, and the other vane may be a second vane 350.

Figure 2:
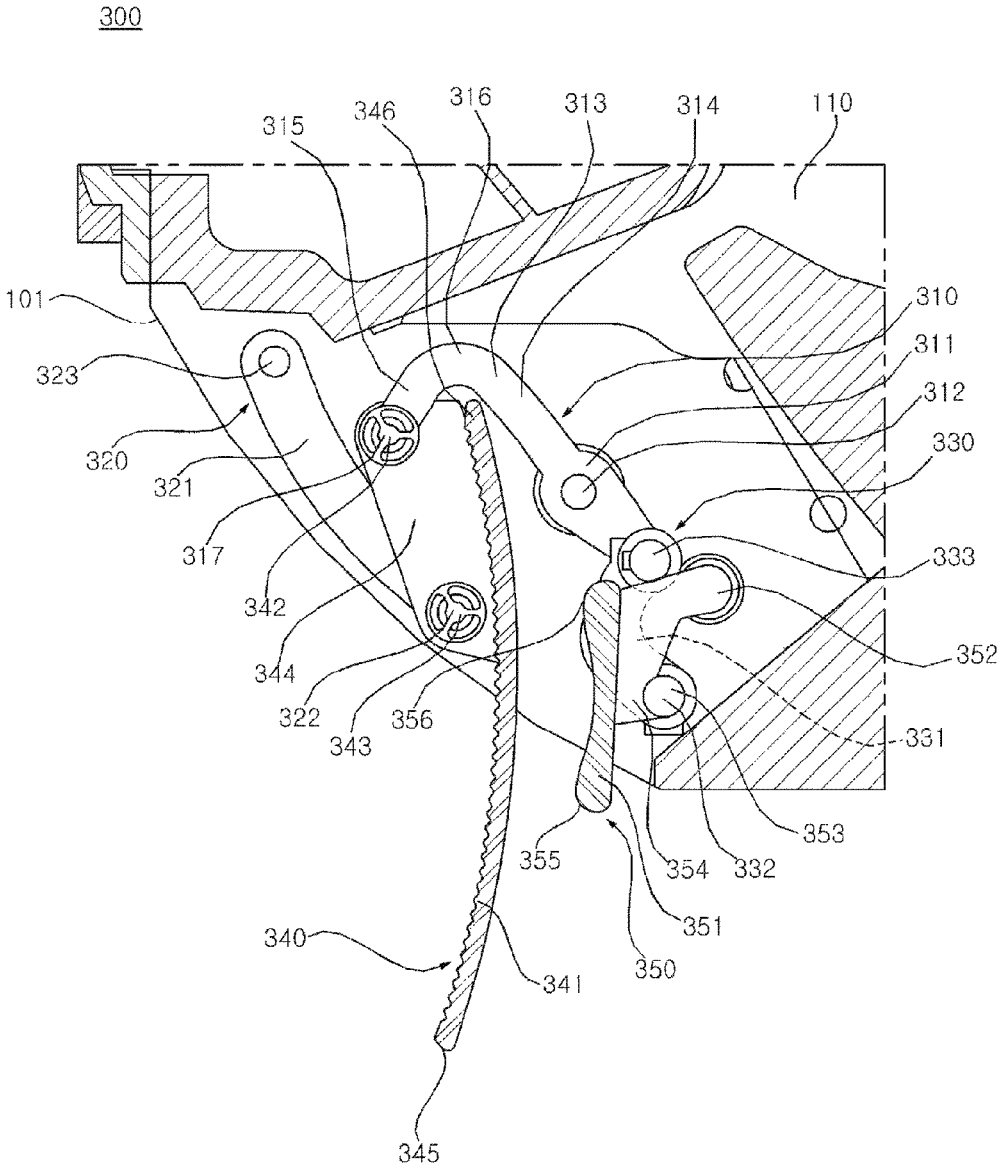
FIGS. 2 and 3 are left-side cross-sectional views of positions of dual vanes in a vertical discharge mode.

Referring to FIG. 2, the indoor unit of the air conditioner according to the present disclosure may include a vane module 300 mounted on one side of the case 100 and guiding a flow direction of air discharged through the outlet 101. The vane module 300 may include a vane motor 200, a drive link 310, a first vane link body 321, a second vane link 330, the first vane 340, and the second vane 350.

Referring to FIG. 1, the vane module 300 may include the vane motor 200 disposed in the case 100 and providing a driving force. The vane motor 200 may be one in number, and two or more thereof may also be provided. In the case where one vane motor 200 is disposed, the vane motor 200 may be disposed on any one of both inner side surfaces. In the case where two vane motors 200 are disposed, the vane motors 200 may be disposed respectively on both inner side surfaces.

A step motor may be used as the vane motor 200. In addition, the vane motor 200 may be directly connected to a core body shaft 312 of the drive link 310. In this case, a rotation direction and a rotation speed of the drive link 310 may be equal to a rotation direction and a rotation speed of the vane motor 200.

The vane motor 200 is disposed on one side of the first vane 340 or the second vane 350. More specifically, the vane motor 200 may be disposed outside of the elongated outlet 101 in the longitudinal direction.

A shaft of the vane motor 200, disposed outside of the outlet 101, passes through one end of the outlet 101 to extend inward, and the shaft may cause the first vane 340 or the second vane 350 disposed inside the outlet 101 to perform motion.

Referring to FIG. 2, the vane module 300 may include the drive link 310 receiving a driving force from the vane motor 200. The drive link 310 is coupled to the shaft of the vane motor 200. The drive link 310 includes a core body 311, a first drive link body 313, and a second drive link body 318.

Figure 6:
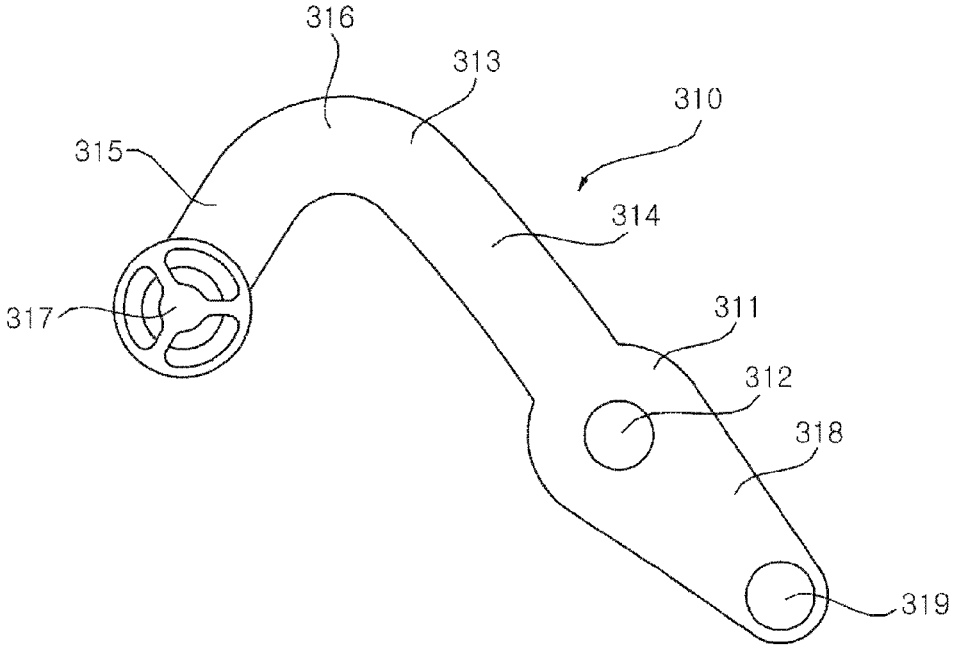
FIG. 6 is a front view of a drive link.
Figure 7:
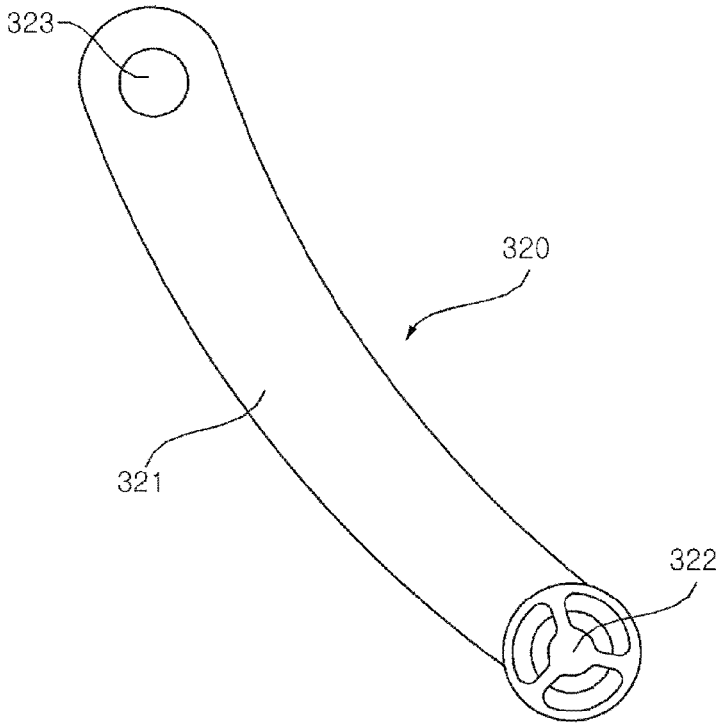
FIG. 7 is a front view of a first vane link.

Referring to FIG. 6, the drive link 310 includes the core body 311 having the core body shaft 312 so as to be rotatable relative to the case 100. In addition, the drive link 310 includes the first drive link body 313 connected to a first end of the core body 311. Further, the drive link 310 includes the second drive link body 318 connected to a second end of the core body 311. The core body shaft 312 receives a driving force from the vane motor 200, and directly transmits the received driving force to the first drive link body 313 and the second drive link body 318.

The vane module 300 includes the first vane link body 321 having one end coupled to the case 100 so as to be rotatable relative to the case 100. The vane module 300 includes the second vane link 330 connected to the second drive link body 318 so as to be rotatable relative to the second drive link body 318. The first vane link body 321 may have a bar shape extending in the longitudinal direction of the outlet 101. When viewed from the side, the outlet 101 may have a curved shape having a curvature, and the first vane link body 321 may have a shape that is curved with the same curvature as the curvature.

The core body 311 is coupled to the shaft of the vane motor 200. The core body 311 is disposed opposite the vane motor 200 with one side wall of the outlet 101 disposed therebetween. The core body 311 includes the core body shaft 312. When the core body 311 is coupled to the shaft of the vane motor 200, the core body shaft 312 of the core body may overlap the shaft.

The first drive link body 313 extends in one direction from the core body 311. The second drive link body 318 extends in another direction from the core body 311. The second drive link body 318 extends in a direction different from an extending direction of the first drive link body 313.

The first drive link body 313 is a component for moving the first vane 340 by transmitting the driving force of the vane motor 200 to the first vane 340.

A first end of the first drive link body 313 is coupled to the core body 311. Alternatively, the first drive link body 313 may be integrally formed with the core body 311. The first drive link body 313 extends in one direction from the core body 311. A second end of the first drive link body 313 is connected to the first vane 340. More specifically, the second end of the first drive link body 313 is connected to a first vane rib 344 of the first vane 340. More specifically, the second end of the first drive link body 313 is connected to a 1-1 vane shaft 342 of the first vane rib 344.

A first drive link shaft 317 may be formed at the second end of the first drive link body 313. When the first drive link body 313 and the first vane 340 are fastened, the first drive link shaft 317 overlaps the 1-1 vane shaft 342.

The first drive link body 313 may include a first member 314, having a first end connected to the core body 311, and a second member 315 having a first end connected to a second end of the first member 314 and a second end connected to the first vane 340 so as to be rotatable relative to the first vane 340. In addition, a connection part 316 for connecting the first member 314 and the second member 315 may be disposed between the first member 314 and the second member 315.

The first member 314 and the second member 315 may extend in different directions with the connection part 316 disposed therebetween. An angle formed between the first member 314 and the second member 315 is less than 180 degrees, and is preferably more or less than about 90 degrees in consideration of durability and the like to stably resist torque. In this case, an angle formed between the first member 314 and the second member 315 may be an included angle between a straight line, connecting a center of gravity of the connection part 316 and a center of gravity of the first member 314, and a straight line connecting a center of gravity of the connection part 316 and a center of gravity of the second member 315, or may be an included angle between a tangent line of the first member 314 and a tangent line of the second member 315. In this case, the center of gravity of each of the connection part 316, the first member 314, and the second member 315 may be located on a plane perpendicular to the core body shaft 312.

The second drive link body 318 is a component for moving the second vane 350 by transmitting the driving force of the vane motor 200 to the second vane 350.

A first end of the second drive link body 318 is coupled to the core body 311. Alternatively, the second drive link body 318 may be integrally formed with the core body 311. The second drive link body 318 extends in one direction from the core body 311. A second end of the second drive link body 318 is connected to the second vane 350. More specifically, the second end of the second drive link body 318 is connected to a first end of the second vane link 330, and a second end of the second vane link 330 is connected to a second vane rib 354 of the second vane 350.

A second drive link shaft 319 is formed at the second end of the second drive link body 318. When the second drive link body 318 and the second vane link are fastened, the second drive link shaft 319 overlaps a 2-2 vane link shaft 333.

The second drive link body 318 extends in a direction opposite an extending direction of the first drive link body 313.

A length of the second drive link body 318 may be shorter than a length of the first drive link body 313. More specifically, a length from the core body 311 to an end portion of the first member 314 may be longer than a length from the core body 311 to an end portion of the second drive link body 318.

A distance from the core body 311 to the end portion of the second drive link body 318 may be shorter than a distance from the core body 311 to a connection point between the second vane 350 and the case 100. In other words, a distance from the core body 311 to the second drive link shaft 319 may be shorter than a distance from the core body 311 to a 2-1 vane shaft 352. Accordingly, when rotating, the drive link 310 may rotate without colliding with the second vane 350, and a radius of rotation of the second vane 350 may be smaller than a radius of rotation of the first vane 340.

The case 100 according to the present disclosure may further include a link mounting portion 110. In this case, the vane module 300 may be mounted in the link mounting portion 110 disposed inside the case 100. Each of the first vane link body 321, the drive link 310, and the second vane 350 may be coupled to the link mounting portion 110 so as to be rotatable relative to the link mounting portion 110. In this case, the link mounting portion 110 may be integrally formed with the case 100 or may be formed separately from the case 100. In the case where the link mounting portion 110 is formed separately from the case 100, the vane module 300 may also be removed together when the link mounting portion 110 is removed from the case 100, thereby reducing the assembly time and facilitating removal and replacement.

The case 100 according to the present disclosure may include a vane motor coupling portion 120 which is disposed inside the case 100, and to which the vane motor 200 is coupled. When the case 100 includes the link mounting portion 110, the vane motor coupling portion 120 may be disposed at the link mounting portion 110. The vane motor coupling portion 120 is a component for stably supporting the vane motor 200 during rotation of the vane motor 200. The vane motor coupling portion 120 may be disposed inside the link mounting portion 110 and may be disposed outside the link mounting portion 110. In the case where the vane motor coupling portion 120 is disposed outside the link mounting portion 110, a hole, through which the shaft of the vane motor 200 may pass, may be formed in the link mounting portion 110 to receive a driving force from the vane motor 200.

A step motor may be used as the vane motor 200. In addition, the vane motor 200 may be directly connected to the core body shaft 312 of the drive link 310. In this case, a rotation direction and a rotation speed of the drive link 310 may be equal to a rotation direction and a rotation speed of the vane motor 200.

Figure 8:
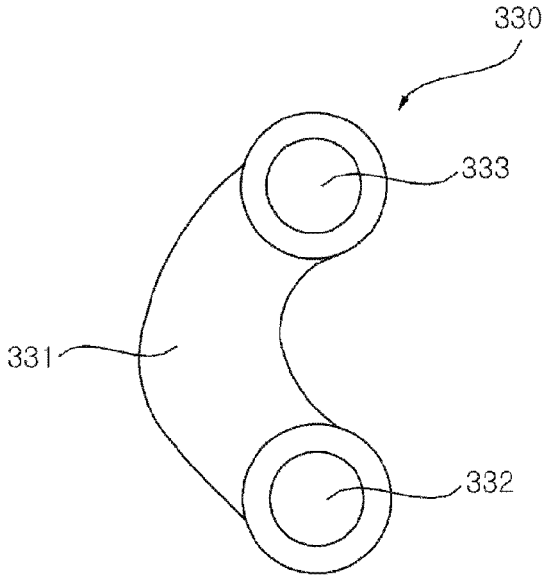
FIG. 8 is a front view of a second vane link.

Meanwhile, referring to FIG. 8, the second vane 350 may include a 2-1 vane shaft 352. The 2-1 vane shaft 352 may be coupled to the link mounting portion 110 so as to be rotatable relative to the link mounting portion 110. A first end of the first vane link body 321 is coupled in a manner that allows relative rotation. The core body shaft 312 of the core body 311, disposed between the 2-1 vane shaft 352 and the first end of the first vane link body 321, may be coupled to the link mounting portion 110 so as to be rotatable relative to the link mounting portion 110. With respect to a discharge flow direction of the air to be discharged, the 2-1 vane shaft 352 is disposed at the front of the link mounting portion 110 and the first end of the first vane link body 321 is disposed at the rear thereof, and the core body shaft 312 is disposed between the 2-1 vane shaft 352 and the first end of the first vane link body 321. That is, the first end of the first vane link body 321, the core body shaft 312, and the 2-1 vane shaft 352 are coupled to the link mounting portion 110 in this order when viewed from the front.

In addition, the second vane link 330 includes a 2-2 vane link shaft 333, connected to the second drive link body 318 so as to be rotatable relative to the second drive link body 318, and a 2-1 vane link shaft 332 connected to the second vane 350 so as to be rotatable relative to the second vane 350. The 2-2 vane link shaft 333 is disposed at a first end of the second vane link 330. The 2-1 vane link shaft 332 is disposed at a second end of the second vane link 330. When the vane motor 200 is in operation and the drive link 310 rotates, the second drive link body 318 of the drive link 310 and the 2-2 vane link shaft 333 rotate about the core body shaft 312 of the drive link 310. In this case, a position of the 2-1 vane shaft 352 of the second vane 350 is fixed to the link mounting portion 110, such that when the drive link 310 rotates, the second drive link body 318 and the second vane 350 make contact with each other, which may restrict rotation. In order to prevent such interference, the 2-2 vane link shaft 333 and the 2-1 vane shaft 352 may be spaced apart from each other by a predetermined distance or more. The distance may be preferably defined as a distance between the 2-2 vane link shaft 333 and the 2-1 vane shaft 352 when the 2-2 vane link shaft 333 and the 2-1 vane shaft 352 are located at a shortest distance to come into contact with each other.

In addition, referring to FIG. 8, the second vane link 330 may have a curved shape so as not to contact or interfere with the second vane 350 during rotation of the drive link 310.

The first vane 340 rotates to open or close the outlet 101 according to a rotation direction. In this case, a rotation direction of the first vane 340 to open the outlet 101 may be defined as a first rotation direction R1. Referring to FIG. 2, the first rotation direction R1 is a counterclockwise direction.

When the first vane 340 rotates in the first rotation direction R1, at least a portion of the first vane 340 may move closer to the connection part 316 of the first drive link body 313.

Figure 9:
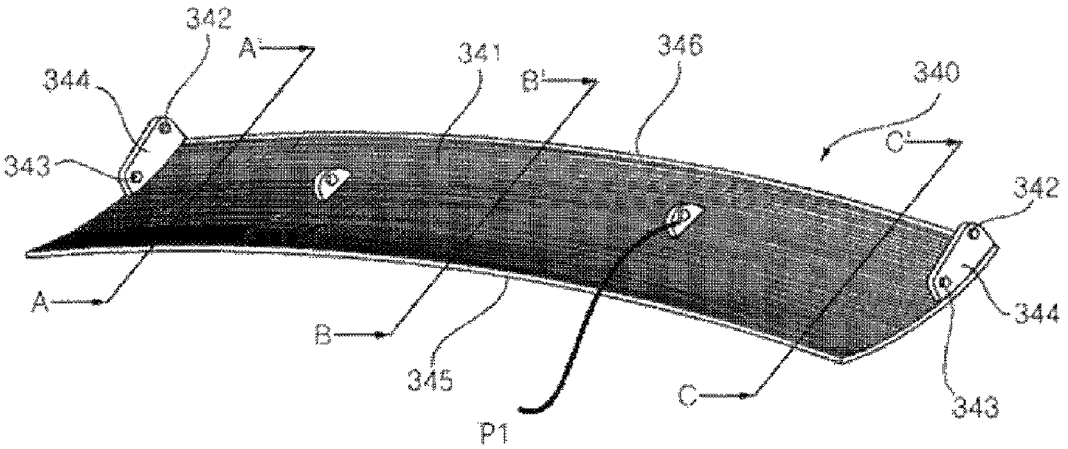
FIG. 9 is a perspective view of a first vane as viewed from above.

Referring to FIG. 9, the first vane 340 has a front end 345, at which the air to be discharged moves further away from the vane, and a rear end 346, at which the air to be discharged moves closer to the vane, with respect to a discharge flow direction of the air. When the first vane 340 rotates in the first rotation direction R1, the rear end of the first vane 340 may move closer to the connection part 316 of the first drive link body 313.

A rotating shaft disposed at the second end of the second member 315 may coincide with the 1-1 vane shaft 342 of the first vane 340. The shaft disposed at the core body 311 and the center of the core body shaft 312 may coincide with each other. The rotating shaft disposed at the second end of the second member 315 may form a straight line with the core body shaft 312. When the first vane 340 rotates in the first rotation direction R1, the rear end of the first vane 340 may pass through the straight line to be closer to the connection part 316.

When the first vane 340 rotates in the first rotation direction R1, the rear end of the first vane 340 may come into contact with the connection part 316. In this case, the first vane 340 no longer rotates in the first rotation direction R1. Accordingly, the connection part 316 may act as a stopper for restricting a maximum rotation range of the first vane 340.

In addition, the first drive link body 313 may have a curved shape or a bent shape. In this case, the connection part 316 of the first drive link body 313 may be formed at a position to come into contact with the rear end of the first vane 340 when the first vane 340 rotates in a maximum rotation range.

Further, when the outlet 101 is opened, the first vane 340 rotates in the first rotation direction R1, and the drive link 310 rotates in a second rotation direction R2. The second rotation direction R2 may be a direction opposite the first rotation direction R1. The second member 315 of the first drive link body 313 may extend from the connection part 316 in a direction opposite the second rotation direction R2.

Meanwhile, a rotation range of the first vane 340 is determined based on an angle of the first vane 340 when the indoor unit stops and the first vane 340 closes the outlet 101. In this case, a maximum rotation angle Amax of the first vane 340 may be 150 degrees, and preferably 140 degrees.

Referring to FIGS. 1 and 8, the vane module 300 may include the first vane 340 formed at the outlet 101.

The first vane 340 is a component disposed at the outlet 101 and guiding air to be discharged. When an electric current is applied, the first vane 340 guides the air to be discharged, and when no electric current is applied, the first vane 340 closes the outlet 101. Closing of the outlet 101 by the first vane 340 means that an upper surface of the first vane 340 comes into close contact with the outlet 101 to spatially separate the outlet 101 from an indoor space. The first vane 340 is disposed perpendicular to the outlet 101 to cover the outlet 101 from the outside. By closing the outlet 101, the first vane 340 may prevent the air conditioner from being contaminated by foreign matter entering into the air conditioner through the outlet 101 when no electric current is applied.

The first vane 340 is connected to the first drive link body 313 so as to be rotatable relative to the first drive link body 313, and may be connected to the second end of the first vane link body 321 so as to be rotatable relative to the second end of the first vane link body 321.

In this embodiment, the first vane 340 may include a first vane body 341, and the first vane body 341 may be elongated in a longitudinal direction of the outlet 101.

Referring to FIG. 9, a direction of the first vane 340 will be defined. With respect to a flow direction of the air to be discharged, a side where air is discharged by being guided by the first vane 340 is a front side. A side where air is drawn before being guided by the first vane 340 is a rear side. In the horizontal discharge mode, a surface for guiding air flowing through an upper portion of the first vane 340 may be referred to as an upper surface. A surface opposite the upper surface and guiding air flowing through a lower portion of the first vane 340 may be referred to as a lower surface. When the air conditioner is viewed, the left of the first vane 340 may be referred to as a left side, and the right of the first vane 340 may be referred to as a right side.

The first vane 340 has a width with a predetermined distance between the front side and the rear side. The first vane 340 may have a generally rectangular shape which is elongated in the longitudinal direction of the outlet 101. The width of the first vane 340 may be defined as a distance between a front end and a rear end thereof. A length of the first vane 340 may be defined as a distance between a left end and a right end thereof.

Figure 11:
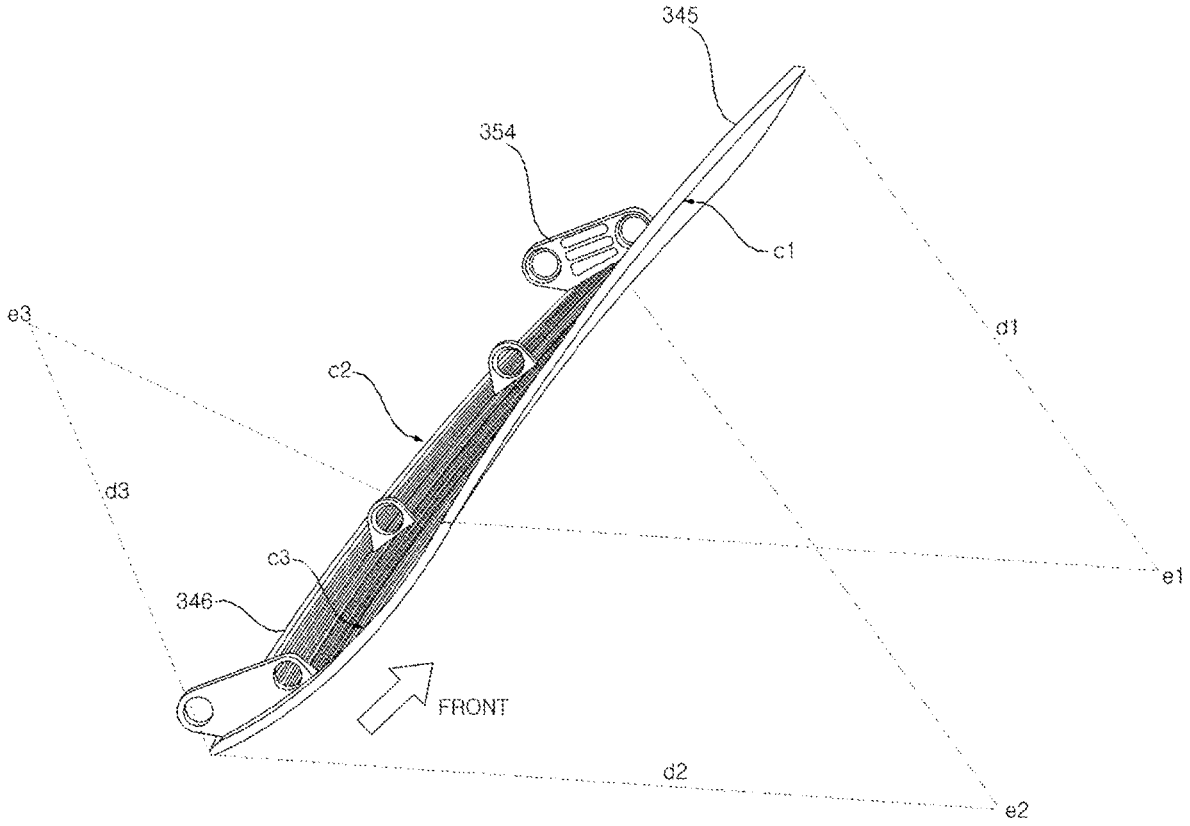
FIG. 11 is a perspective view of a first vane as viewed from the left side.

In addition, referring to FIGS. 9 and 11, the first vane 340 may include the first vane rib 344 protruding from an upper side of the first vane 340. The first vane rib 344 may be disposed at the rear of the upper surface of the first vane 340.

The 1-1 vane shaft 342, connected to the first drive link shaft 317 of the first drive link body 313 so as to be rotatable relative to the first drive link shaft 317, may be formed in the first vane rib 344. When the first drive link body 313 is connected to the first vane 340, the first drive link shaft 317 and the 1-1 vane shaft 342 overlap each other.

A 1-2 vane shaft 343, connected to the 1-1 vane link shaft 322 of the first vane link body 321 so as to be rotatable relative to the 1-1 vane link shaft 322, may be formed in the first vane rib 344. When the first vane rib 344 is connected to the first vane 340, the 1-1 vane link shaft 322 and the 1-2 vane shaft 343 overlap each other.

In addition, in the first vane rib 344, the 1-1 vane shaft 342 may be disposed adjacent to the rear end side of the first vane 340 and the 1-2 vane shaft 343 may be disposed adjacent to the front end side of the first vane 340. In other words, the 1-1 vane shaft 342 may be disposed behind the 1-2 vane shaft 343. In other words, a connection point between the drive link 310 and the first vane 340 may be located behind a connection point between the first vane link 320 and the first vane 340.

Further, with respect to a longitudinal direction of the second member 315, a distance between the first end of the second member 315 and the 1-1 vane shaft 342 may be shorter than a shortest distance between the 1-1 vane shaft 342 and the 1-2 vane shaft 343. Specifically, among points on a tangent line of a slope which is perpendicular to the longitudinal direction of the second member 315, a distance between a point, located further away from the 1-1 vane shaft 342, and a center of the 1-1 vane shaft 342 may be shorter than a shortest distance between the center of the 1-1 vane shaft 342 and the 1-2 vane shaft 343.

This is because, when the first vane 340 is closed, the first vane 340 rotates in a direction opposite the first rotation direction R1, and the drive link 310 rotates in a direction opposite the second rotation direction R2, in which case a portion of the first drive link body 313 passes through a space between the 1-1 vane shaft 342 and the 1-2 vane shaft 343 of the first vane rib 343, thereby causing interference between the first vane 340 and the drive link 310, and restricting a rotation range of the first vane 340.

A distance between the connection part 316 and the first drive link shaft 317 may be shorter than a distance between the 1-1 vane shaft 342 and the 1-2 vane shaft 343. Accordingly, when the first vane 340 rotates in the second rotation direction to close the outlet 101, the second member is disposed between the 1-1 vane shaft 342 and the 1-2 vane shaft 343.

Referring to FIGS. 9 and 11, the first vane 340 is disposed at the outlet 101 and has a plate shape.

An upper surface of the first vane 340 is an inner surface in an air inflow direction when the first vane 340 closes the outlet. A lower surface of the first vane 340 is an outer surface in an air discharge direction when the first vane 340 closes the outlet. A front surface of the first vane 340 is a surface disposed at an upper end of the outlet when the first vane 340 closes the outlet. In the first vane 340, a rear surface of the first vane 340 first comes into contact with the discharge air. A rear surface of the first vane 340 is a surface disposed at a lower end of the outlet when the first vane 340 closes the outlet. The rear surface of the first vane 340 is disposed opposite the front surface. The first vane 340 has a left surface disposed at a left end of the outlet. The first vane 340 has a right surface opposite the left surface of the first vane 340. The right surface of the first vane 340 is disposed at a right end of the outlet.

In other words, the outlet is elongated from side to side, and the first vane 340 is formed in a plate shape which is elongated from side to side.

Referring to FIG. 11, the first vane 340 has a curvature C on the upper surface or the lower surface of the first vane 340. The first vane 340 may have a dual curvature on the upper surface or the lower surface of the first vane 340.

Referring to FIG. 11, the first vane 340 has first and second curvatures c1 and c2 on the upper surface or the lower surface in the longitudinal direction of the outlet 101. The first and second curvatures c1 and c2 are elongated in the longitudinal direction of the outlet 101. In the first vane 340 having the first and second curvatures c1 and c2, both ends of the first vane 340 and the center of the first vane 340 have different heights.

When the air conditioner is in operation, the first vane 340 does not close the outlet 101, and both ends of the first vane 340 and the center of the first vane 340 are disposed at different heights and guide the air to the discharged.

When the air conditioner stops, the first vane 340 closes the outlet 101, and the center of the first vane 340 sags downward due to self-weight. When a restoring force, provided in response to deformation of the first vane having the first and second curvatures c1 and c2, is equal to load from the self-weight, the first vane 340 has a flat plate shape, thereby tightly closing the outlet 101.

The first vane 340 has a third curvature c3 on the upper surface or the lower surface in a direction intersecting the first and second curvatures c1 and c2. Referring to FIG. 11, the first curvature c1 and the second curvature c2 are formed in a horizontal or left-to-right direction, and the third curvature c3 is formed in a vertical or up-down direction. The first curvature c1 is formed at the front end 345 of the first vane in the horizontal direction, and the second curvature c2 is formed at the rear end 346 of the first vane in the horizontal direction, such that the first curvature c1 and the second curvature c2 are parallel to each other. However, the third curvature c3 is formed in the vertical direction, and thus intersects the first curvature c1 and the second curvature c1 as well.

The first vane 340 may have a dual curvature of the first and second curvatures c1 and c2 and the third curvature c3. Referring to FIG. 11, the first vane 340 may have both the first and second curvatures c1 and c2 in the horizontal direction, as well as the third curvature c3 in the vertical direction. The first and second curvatures c1 and c2 and the third curvature c3 are formed in directions intersecting each other, and all are formed on the first vane 340, thereby making the first vane 340 more resistant to deformation.

Figure 12:
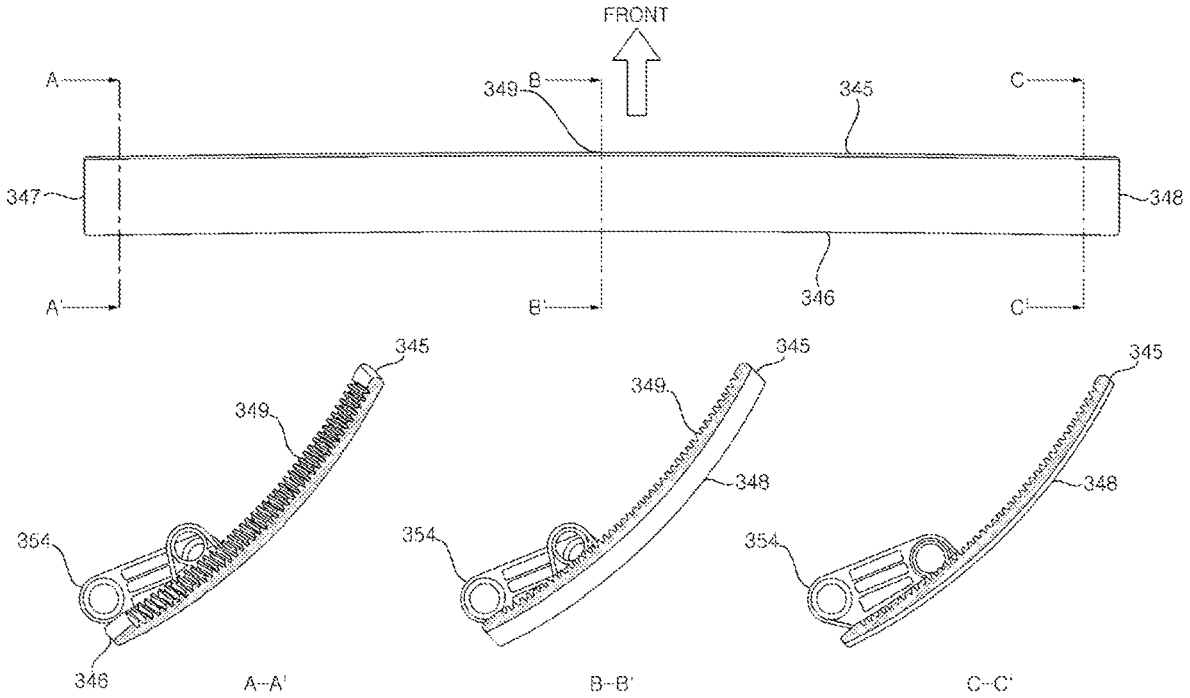
FIG. 12 is a bottom view of a first vane and a left-side cross-sectional view as viewed from each cross section thereof.

FIG. 12 is a left-side cross-sectional view of the first vane 340 at each position thereof. FIG. 12 is a cross-sectional view as seen from the right side at positions A, B, and C which are the same as positions A, B, and C of FIG. 9. Referring to a cross-sectional view taken along line A-A' seen from the right side, the first and second curvatures c1 and c2 are formed such that a body of the first vane 340 is inclined upward, and a central part 349 is disposed above the cross-section of line A-A'. Referring to a cross-sectional view taken along line B-B' seen from the right side, the first vane 340 is inclined downward, and a right end 348 is disposed below the central part 349. Referring to a cross-sectional view taken along line C-C' seen from the left side, the right end 348 is disposed below the cross-section of line C-C'. That is, referring to FIG. 12, with respect to the central part 349 located at position B, the body of the first vane 340 from the left end 347 to the left side of the central part 349 has a rising slope, and the body of the first vane 340 from the right side of the central part 349 to the right end 348 has a falling slope.

The first vane 340 has the first curvature c1 formed on a surface perpendicular to an air discharge direction and in the longitudinal direction of the outlet 101. Preferably, referring to FIG. 11, the first vane 340 has the first curvature c1 so that the upper surface thereof may be convex upward. In this case, a first center of curvature e1 may be located below the first vane 340.

The first curvature c1 is concave in the air discharge direction when the first vane 340 closes the outlet 101. When the first vane 340 closes the outlet 101, the air discharge direction corresponds to the lower surface of the first vane 340, and the first curvature c1 may be formed so that the lower surface thereof may be concave.

The first curvature c1 may be formed so that the upper surface may be convex upward.

The first vane 340 is supported at both ends 347 and 348, and the central part 349 of the first vane sags downward due to self-weight. Accordingly, when the first vane 340 closes the outlet 101, the central part 349 of the first vane sags downward, thereby causing a problem in that the center of the outlet 101 may not be tightly closed.

Meanwhile, in the case where a third vane link 360 for guiding rotation of the first vane 340 is disposed inside the first vane 340, resistance occurs due to the third vane link 360 when the first vane 340 rises. Accordingly, when the first vane 340 moves, the central part 349 of the first vane rotates by an angle of less than a rotation angle of both ends of the first vane connected with the first vane link. Accordingly, torsion occurs in the central part 349 of the first vane by a displacement difference. As a result, when the first vane 340 closes the outlet 101, the center of the outlet 101 may not be tightly closed due to the torsion.

Accordingly, when the first vane 340 closes the outlet, a problem occurs in that the first vane 340 sags due to self-weight or the center thereof is not tightly closed due to torsion caused by the third vane link 360. According to the present disclosure, the upper surface is convex upward with the first and second curvatures c1 and c2, such that even when sagging occurs due to self-weight of the first vane 340 or torsion occurs due to the third vane link 360, the first vane 340 may tightly close the outlet 101.

Referring to FIG. 11, the first curvature c1 may be formed at the front end of the first vane 340. In this case, the first vane 340 may have the second curvature c2 formed at the rear end of the first vane 340. The second curvature c2 is formed at the rear end of the first vane 340 and has a second radius of curvature d2 which is different from the first radius of curvature d1 of the first curvature c1. The first radius of curvature d1 is shorter than the second radius of curvature d2.

Figure 13:
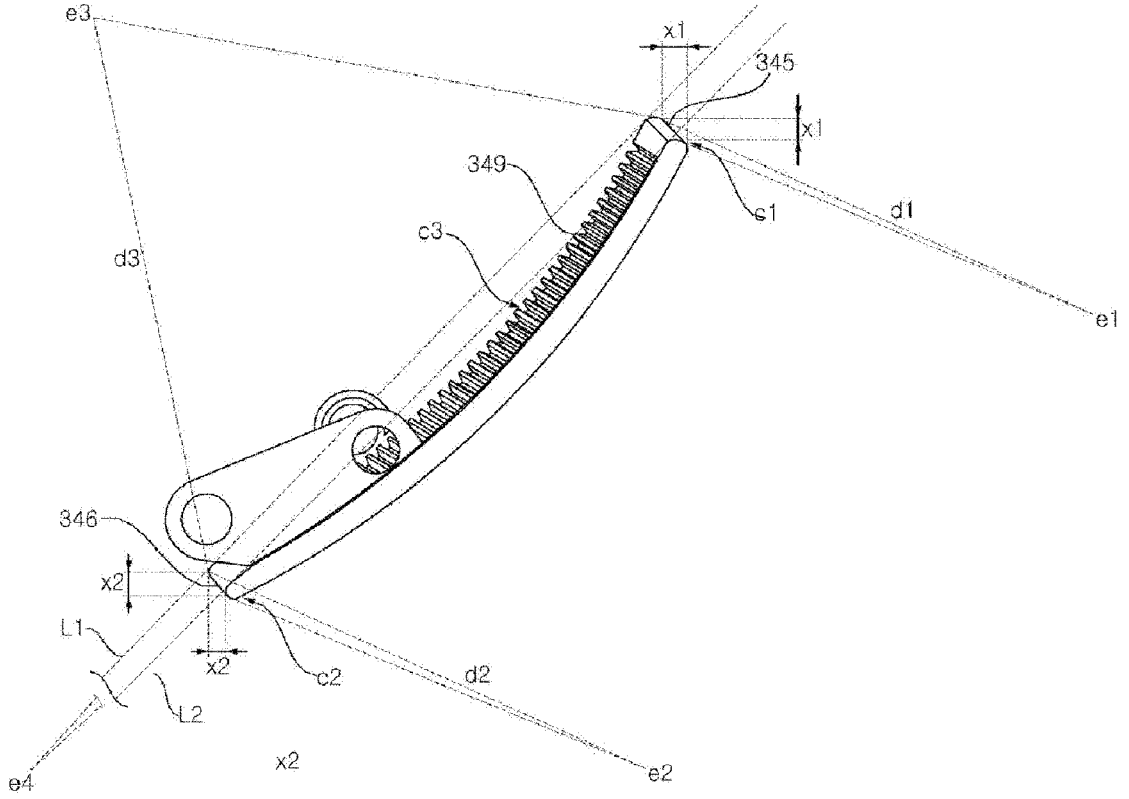
FIG. 13 is a left side view of a first vane.

Referring to FIG. 13, a front end of the central part 349 of the first vane protrudes upward above the left end thereof. The front end of the central part 349 of the first vane may be spaced apart upward from the left end by x1, and then leftward by x1 again. For example, the value x1 may be about 3.5 mm. Referring to FIG. 13, the rear end of the central part 349 of the first vane may protrude upward above the left end. The rear end of the central part 349 of the first vane may be spaced apart upward from the left end by x2, and then leftward by x2 again. For example, compared to the value of x1, the value of x2 may be about 3.4 mm.

As described above, the value of x1 is greater than the value of x2, and thus the front end of the central part 349 of the first vane may protrude further upward than the rear end of the central part 349 of the first vane. In addition, the first radius of curvature d1 is shorter than the second radius of curvature d2. Further, the first center of curvature e1 is disposed closer to the first vane 340 than a second center of curvature e2.

Figure 14:
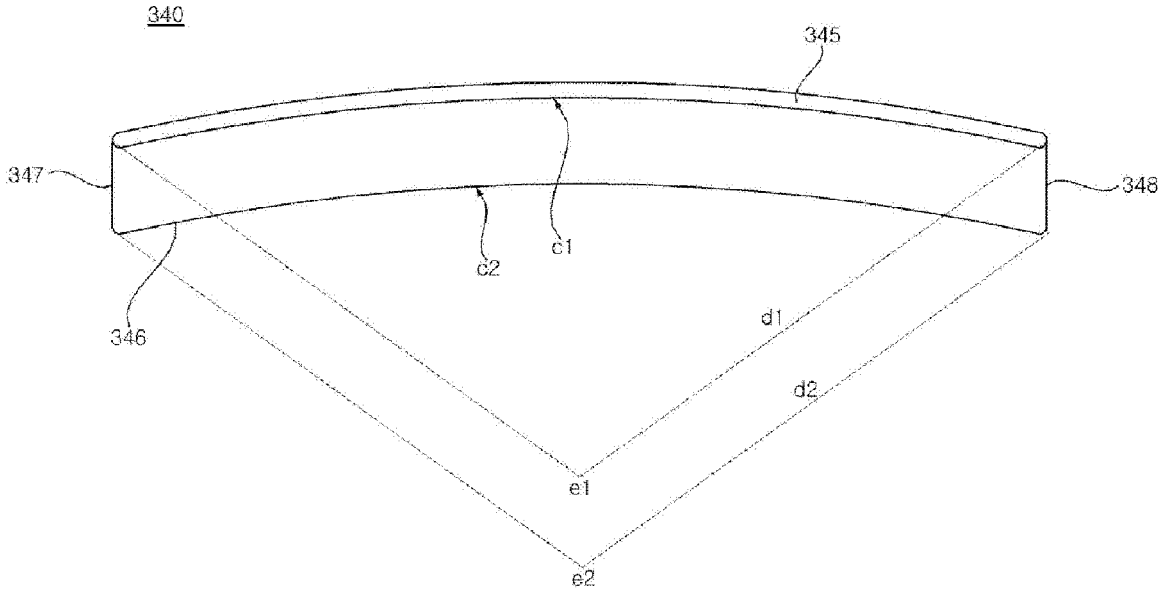
FIG. 14 is a perspective view of a first vane as viewed from below.

Referring to FIG. 14, the first radius of curvature d1 is shorter than the second radius of curvature d2, such that the front end of the first vane 340 has a steeper curvature than the rear end of the first vane 340. The third vane link 360 is disposed at a rear portion of the first vane 340, such that when torsion occurs due to the third vane link 360, the front end of the first vane 340 is deformed to a much greater degree than the rear end of the first vane. Accordingly, the first radius of curvature c1 is shorter than the second radius of curvature c2, such that when torsion occurs due to the third vane link 360, the front end and the rear end of the first vane 340 may be parallel to each other, thereby tightly closing the outlet 101.

The center of curvature e1 of the first curvature c1 may coincide with the center of curvature e2 of the second curvature c2.

Referring to FIG. 11, the first vane 340 has the third curvature c3 formed in a direction intersecting a direction in which the first curvature c1 is formed. In other words, the third curvature c3 is formed in a direction intersecting the longitudinal direction of the outlet 101 and is formed on the upper surface or the lower surface. Referring to FIG. 13, the first vane 340 preferably has the third curvature c3 so that the upper surface thereof may be convex upward. In this case, a third center of curvature e3 may be located above the first vane 340.

The third curvature c2 may be formed in a direction perpendicular to the direction of the first curvature c1. In other words, the third curvature c3 may be formed perpendicular to the longitudinal direction of the outlet 101.

When the first vane 340 closes the outlet 101, the third curvature c3 is convex in the air discharge direction. The air discharge direction when the first vane 340 closes the outlet 101 indicates a lower side of the first vane 340. In other words, the third curvature c3 is convex downward.

With respect to the first vane 340, the center of curvature e3 of the third curvature c3 is disposed opposite the center of curvature e1 of the first curvature. That is, referring to FIG. 13, the center of curvature e1 of the first curvature is located below the first vane 340, and the center of curvature e3 of the third curvature is located above the first vane 340.

The first curvature c1 and the third curvature c3 are formed in directions intersecting each other, thereby producing an effect of being resistant to external impact and deformation.

With respect to the first vane 340, the center of curvature of the first curvature c1 is located opposite the center of curvature of the third curvature c3, thereby producing an effect of being resistant to impact and deformation.

The first vane link 320 is a component for guiding movement of the first vane 340. The first vane link 320 guide movement of the first vane 340 along with the drive link 310.

Referring to FIGS. 1 and 2, a first end of the first vane link 320 is connected to the case 100, and a second end thereof is connected to the first vane 340. The first vane link 320 rotates about a connection point, at which the first vane link 320 is connected to the case 100 and which serves as a rotational axis. The connection point between the first vane link 320 and the case 100 is defined as the 1-2 vane link shaft 323. The first vane 340 may move along a virtual circular trajectory centered on the 1-2 vane link shaft 323.

The first vane link 320 includes the first vane link body 321. The first vane link body 321 forms the exterior of the first vane link 320.

The first vane link body 321 may be curved. The first vane link body 321 may include a curved portion that is convex in a direction opposite the drive link 310. Accordingly, when rotating, the drive link 310 remains separated from the first vane link body 321.

The first vane link 320 includes the 1-2 vane link shaft 323. The 1-2 vane link shaft 323 is disposed at a first end of the first vane link body 321. The 1-2 vane link shaft 323 coincides with the connection point between the first vane link 320 and the case 100.

The first vane link 320 includes the 1-1 vane link shaft 322. The 1-1 vane link shaft 322 is disposed at a second end of the first vane link body 321. The 1-1 vane link shaft 322 coincides with the connection point between the first vane link 320 and the first vane 340. That is when the first vane link 320 is connected with the first vane 340, the 1-1 vane link shaft 322 overlaps the 1-2 vane shaft 343.

The first vane link 320 is disposed at the front of the drive link 310. When the drive link 310 rotates in one direction, the first vane link 320 rotates to guide the first vane 340 toward the front.

The air conditioner further includes the third vane link 360 having a first end connected to the case and a second end connected to the upper surface of the first vane 340, and located further inward than the first vane link 320. Referring to FIG. 1, the first end of the third vane link 360 may be connected to the upper end of the outlet 101. The third vane link 360 is disposed between the first vane link 320, fastened to the left end of the first vane 340, and the first vane link 320 fastened to the right end of the first vane 340. The third vane link 360 may be disposed symmetrically. The third vane link 360 is disposed inside the first vane link 320, thereby preventing the central part 349 of the first vane 340 from sagging due to self-weight.

However, the third vane link 360 may cause torsion during rotation of the first vane 340. For example, when frictional force exists at the connection point between the third vane link 360 and the case, the third vane link 360 may act as resistance during rotation of the first vane 340. Accordingly, the central part 349 of the first vane, to which the third vane link 360 is connected, moves less than the left end 347 or the right end 348 of the first vane, to which the first vane link 320 is connected. Torsion may occur due to the displacement difference.

The connection point between the third vane link 360 and the first vane 340 is located above the connection point between the first vane link 320 and the first vane 340. Referring to FIG. 13, the connection point between the third vane link 360 and the first vane 340 is spaced apart from the connection point between the first vane link 320 and the first vane 340, in order to stably support the first vane 340 with different rotational axes during vibration. Further, the central part 349 of the first vane 340 protrudes upward by a predetermined distance with the first curvature c1, such that the connection point between the third vane link 360 and the first vane 340 is located above the connection point between the first vane link 320 and the first vane 340, and the first vane 340 is stably supported during rotation.

Referring to FIG. 13, the connection point between the first vane 340 and the first vane link 320 is spaced apart from the connection point between the first vane 340 and the first drive link body 313. The connection point between the first vane 340 and the first vane link 320 is located at the rear end of the first vane 340. The connection point between the first vane 340 and the first drive link body 313 is located in front of the connection point between the first vane 340 and the first vane link 320. The connection point between the first vane 340 and the first vane link 320 is spaced apart from the connection point between the first vane 340 and the first drive link body 313, such that during rotation of the drive link 310, the first vane 340 may move in a translational motion along with the rotational motion. However, torsion occurs during the translational motion, such that the third vane link 360 may not effectively guide the rotational motion of the first vane 340. Accordingly, by forming the first curvature c1 or the second curvature c2 for the first vane 340, the outlet may be tightly closed even when the first vane 340 is deformed due to torsion.

Referring to FIG. 13, a virtual first straight line L1, connecting the front end of the left surface or the right surface of the first vane 340, intersects a virtual second straight line L2 connecting the front end and the rear end of the central part of the first vane 340. More specifically, the first straight line L1 and the second straight line L2 overlap each other at the rear of the first vane 340. Referring to FIG. 13, the virtual first straight line L1 connecting the front end and the rear end of the left end 347 of the first vane 340 intersects the virtual second straight line L2 connecting the front end and the rear end of the central part of the first vane 340. More specifically, the first straight line L1 and the second straight line L2 overlap each other at the rear of the first vane 340. In other words, with respect to an intersecting point e4, a slope of the second straight line L2 is steeper than a slope of the first straight line L1. When viewed from the side, the third vane link 360 is disposed at a rear portion of the first vane 340. Accordingly, when torsion occurs due to the third vane link 360, the front end of the first vane 340 is deformed to a greater degree than the rear end thereof. Accordingly, when torsion occurs, the front side of the second straight line L2 is deformed more than the rear side, and the second straight line L2 moves in a direction to overlap the first straight line L1. Accordingly, even when torsion occurs, the first vane 340 may tightly close the outlet.

A distance between the first end and the second end of the third vane link 360 may be shorter than a distance between the first end and the second end of the first vane link 320. The connection point between the third vane link 360 and the first vane 340 is located above the connection point between the first vane link 320 and the first vane 340, and the third vane link 360 may have a shorter length than the first vane link 320.

Referring to FIG. 1, the second vane 350 is a component disposed at the rear of the first vane 340 and guiding discharge of air along with the first vane 340. The vane module 300 is disposed at the outlet 101, and may include the second vane 350 disposed behind the first vane 340 with respect to the discharge flow direction of the air to be discharged.

Figure 10:
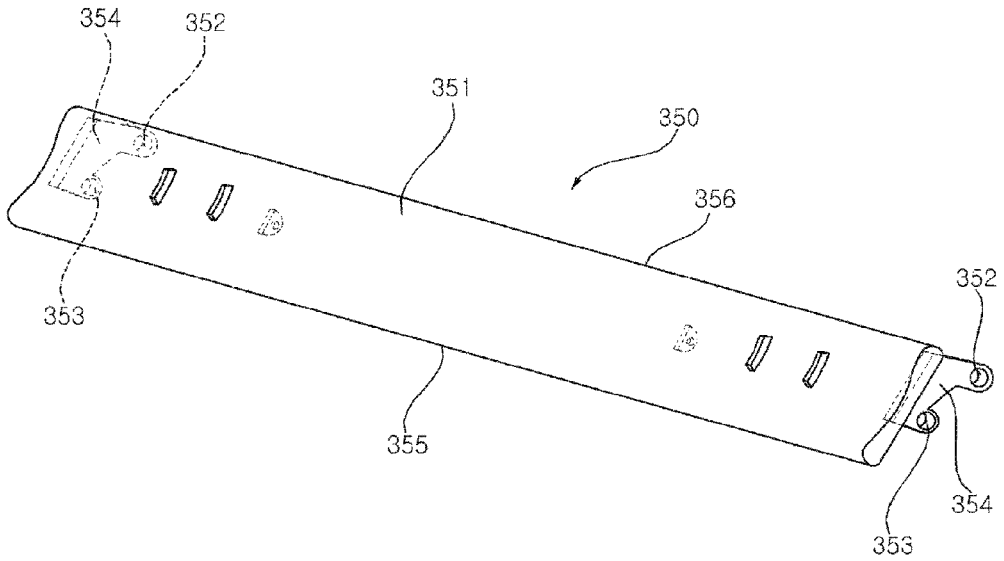
FIG. 10 is a perspective view of a second vane as viewed in one direction.

Referring to FIG. 10, the second vane 350 may be connected to the second end of the second vane link 330 so as to be rotatable relative to the second end of the second vane link 330. The second vane 350 may be coupled to the case 100 so as to be rotatable relative to the case 100.

Referring to FIG. 10, a direction of the second vane 350 will be defined. With respect to a discharge flow direction of the air to be discharged, a side where air is discharged by being guided by the first vane 340 is a front side. A side where air is drawn before being guided by the first vane 340 is a rear side. That is, the second vane 350 is disposed at the rear of the first vane 340. In the horizontal discharge mode, a surface for guiding air flowing through an upper portion of the second vane 350 may be referred to as an upper surface. A surface opposite the upper surface and guiding air flowing through a lower portion of the second vane 350 may be referred to as a lower surface. When the air conditioner is viewed, the left of the second vane 350 may be referred to as a left side, and the right of the second vane 350 may be referred to as a right side.

In this embodiment, the second vane 350 includes the second vane body 351, and the second vane body 351 may be elongated in the longitudinal direction of the outlet 101. With respect to the discharge flow direction of the air to be discharged, a side where the discharge air is discharged is the front side, and a side where the discharge air is drawn is the rear side. The second vane 350 has a width with a predetermined distance between the front side and the rear side. The second vane 350 may have a generally rectangular shape which is elongated in the longitudinal direction of the outlet 101.

A width of the second vane 350 may be defined as a distance between the front end and the rear end. A length of the second vane 350 may be defined as a distance between the left end and the right end.

In addition, the second vane 350 may include the second vane rib 354 protruding from the second vane 350. The second vane rib 354 may be disposed at the rear of the second vane 350. The second vane rib 354 may be formed on the upper surface or the lower surface of the second vane 350.

Referring to FIG. 10, the 2-1 vane shaft 352, coupled to the link mounting portion 110 so as to be rotatable relative to the link mounting portion 110, may be formed in the second vane rib 354. The 2-2 vane shaft 353, connected to the second vane link 330 so as to be rotatable relative to the second vane link 330, may be formed in the second vane rib 354.

Further, the 2-1 vane shaft 352 may be disposed in front of the 2-2 vane shaft 353 in the second vane rib 354.

The second vane rib 354 may be disposed at a position opposite the first vane rib 344. For example, in the case where the first vane rib 344 is disposed on the upper surface of the first vane 340, the second vane rib 354 is disposed on the lower surface of the second vane 350.

The second vane link 330 is connected to the second vane rib 354. In the case where the second vane link 330 is connected to the second vane rib 354, the 2-2 vane shaft 353 of the second vane link 350 overlaps the 2-1 vane link shaft 332 of the second vane link 330.

The second vane rib 354 is connected to one side of the case 100. The second vane 350 rotates about a connection point, at which the second vane rib 354 is connected to the case 100, and which serves as a rotational axis.

The connection point between the second vane link 330 and the second vane rib 354 is disposed in front of the connection point between the case 100 and the second vane rib 354. That is, the 2-1 vane shaft 352 is disposed in front of the 2-2 vane shaft 353.

The connection point between the second vane link 330 and the second vane rib 354 is located closer to the second vane 350 than the connection point between the case 100 and the second vane rib 354. That is, the 2-1 vane shaft 352 is disposed closer to the second vane 350 than the 2-2 vane shaft 353.

The second vane link 330 is a component for guiding movement of the second vane 350 along with the drive link 310. Referring to FIG. 8, a first end of the second vane link 330 is connected to the second rive link body 318, and a second end thereof is connected to the second vane 350. More specifically, the second end of the second vane link 330 is connected to the second vane rib 354 of the second vane 350. In addition, the second vane link 330 includes the 2-2 vane link shaft 333 connected to the second drive link body 318 so as to be rotatable relative to the second drive link body 318, and the 2-1 vane link shaft 332 connected to the second vane 350 so as to be rotatable relative to the second vane 350. The 2-2 vane link shaft 333 is disposed at the first end of the second vane link 330. The 2-1 vane link shaft 332 is disposed at the second end of the second vane link 330.

Referring to FIG. 8, when the vane motor 200 is in operation and the drive link 310 rotates, the second drive link body 318 of the drive link 310 and the 2-2 vane link shaft 333 rotate about the core body shaft 312 of the drive link 310. In this case, a position of the 2-1 vane shaft 352 of the second vane 350 is fixed to the link mounting portion 110, such that when the drive link 310 rotates, the second drive link body 318 and the second vane 350 make contact with each other, which may restrict rotation.

In order to prevent such interference, the 2-2 vane link shaft 333 and the 2-1 vane shaft 352 may be spaced apart from each other by a predetermined distance or more. The distance may be preferably defined as a distance between the 2-2 vane link shaft 333 and the 2-1 vane shaft 352 when the 2-2 vane link shaft 333 and the 2-1 vane shaft 352 are located at a shortest distance to come into contact with each other.

Figure 3:
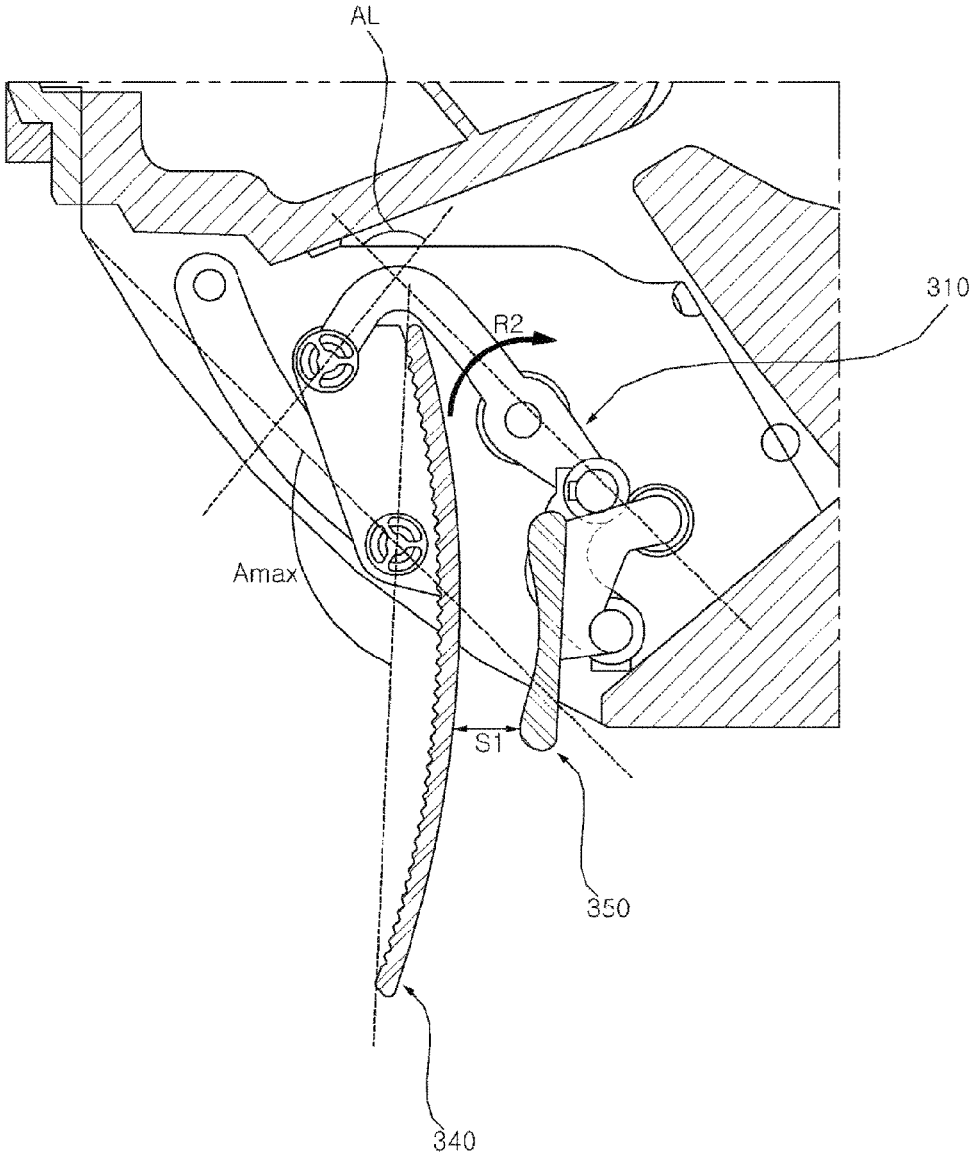

Referring to FIG. 3, a distance from the core body 311 to the end portion of the second drive link body 318 may be shorter than a distance from the core body 311 to a connection point between the second vane 350 and the case 100. In other words, a distance from the core body 311 to the second drive link shaft 319 may be shorter than a distance from the core body 311 to the 2-1 vane shaft 352. Accordingly, when rotating, the drive link 310 may rotate without colliding with the second vane 350, and a radius of rotation of the second vane 350 may be smaller than a radius of rotation of the first vane 340.

In addition, the second vane link 330 may have a curved shape so as not to contact or interfere with the second vane 350 during rotation of the drive link 310. The second vane link 330 may have a curved portion which is convex in a direction opposite the connection point between the second vane 350 and the case 100. The second vane link 330 may be formed in an arc shape around the connection point between the second vane 350 and the case 100. In other words, the second vane link 330 may be formed in an arc shape around the 2-1 vane shaft 352. Accordingly, it is possible to prevent the second vane link body 331 from colliding with the 2-1 vane shaft 352 during rotation of the second vane link 330.

In this embodiment, the core body shaft 312 may be coupled or connected to the link mounting portion 110, the 1-2 vane link shaft 323 may be coupled or connected to the link mounting portion 110, the 2-1 vane shaft 352 may be coupled or connected to the link mounting portion 110, the 1-1 vane link shaft 322 may be coupled or connected to the 1-2 vane shaft 343, the first drive link shaft 317 may be coupled or connected to the 1-1 vane shaft 342, the second drive link shaft 319 may be coupled or connected to the 2-2 vane link shaft 333, and the 2-2 vane shaft 353 may be coupled or connected to the 2-1 vane link shaft 332, so as to be rotatable relative to each other, respectively, by a fastening member (not shown).

In this embodiment, with respect to the longitudinal direction of the outlet, the first vane 340 may be longer than the second vane 350. However, the lengths thereof are not limited thereto, and the second vane 350 may also be shorter than the first vane 340.

In order to increase the length of the second vane 350, the case 100 or the link mounting portion 110 is required to have enough space to extend the length. To this end, a slot (not shown) is formed in the case 100 or the link mounting portion 110, and the core body 311 of the drive link 310 may be disposed outside of the case 100 or the link mounting portion 110. Remaining portions, other than the core body 311 of the drive link 310, may pass through the slot (not shown) to be disposed inside the case 100 or the link mounting portion 110. Accordingly, a space for extending the length of the second vane 350 may be secured. In this case, the effect of guiding discharge of the discharge air via the second vane 350 may be maximized. In addition, a space of the outlet 101 may be further secured, thereby reducing discharge flow resistance of the discharge air.

In this embodiment, the first vane 340 and the second vane 350 rotate respectively by rotation of the drive link 310 that receives a driving force from the vane motor 200. In a vertical discharge mode for guiding discharge of the discharge air in a vertical direction, each of the first vane 340 and the second vane 350 rotates to be disposed vertically. In this case, the discharge air is discharged through the front side of the first vane 340, a space between the first vane 340 and the second vane 350, and the rear side of the second vane 350, respectively. In the vertical discharge mode, a shortest distance between the first vane 340 and the second vane 350 is referred to as a first vane distance S1.

Referring to FIG. 3, in a horizontal discharge mode for guiding discharge of the discharge air in a horizontal direction, each of the first vane 340 and the second vane 350 rotates to be disposed horizontally. In this case, a shortest distance between the first vane 340 and the second vane 350 is referred to as a second vane distance S2.

The second vane distance S2 may be shorter than the first vane distance S1. This is because, in the horizontal discharge mode, unlike the vertical discharge mode, the discharge air, which is guided by the second vane 350, is guided once more by the first vane 340, such that the discharge air may be discharged further away in the horizontal direction. The second vane distance S2 may be preferably short so that the first vane 340 and the second vane 350 may form one continuous surface. In this case, the first vane 340 and the second vane 350 may act as one vane with a sum of respective widths, to guide discharge of the air, thereby reducing dispersion of the discharge air, and allowing the discharge air to be discharged further away in an indoor space.

When the first vane 340 rotates in a direction opposite the first rotation direction R1 to close the outlet 101, the first vane 340 may be disposed to form a continuous surface with the case 100. Further, in this case, the second vane 350 is disposed at the rear of the first vane 340, and may overlap at least a portion of the first vane 340. When the indoor unit stops and the first vane 340 closes the outlet 101, it is possible to prevent contaminants, such as dust entering from the outside, thereby providing a hygienic effect. In addition, the first vane 340, forming a continuous surface with the case 100, may be formed with a uniform exterior appearance. The second vane 350 is covered by the inside of the first vane 340, thereby producing a maximum aesthetic effect by providing exterior appearance which is neat and clean, and not shoddy.

Hereinafter, a method of operating an air conditioner according to the present disclosure will be described.

Depending on positions of vanes, the air conditioner according to the present disclosure may operate in the horizontal discharge mode and the vertical discharge mode.

Figure 5:
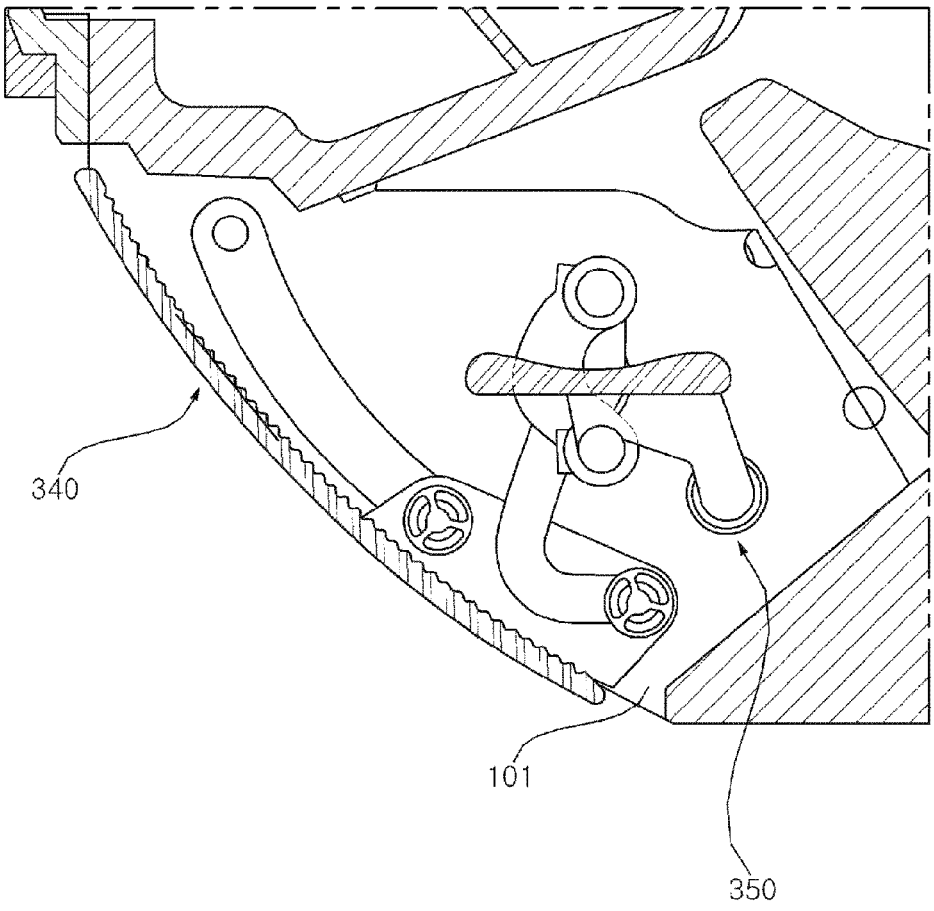
FIG. 5 is a left-side cross-sectional view of positions of dual vanes when no electric current is applied.

Referring to FIG. 5, while not in operation (with no electric current being applied), the first vane 340 closes the outlet 101. The second vane 350 may be disposed in an air inflow direction of the first vane 340 and overlaps at least a portion of the first vane 340. The second vane 350 is covered by the first vane 340.

Figure 4:
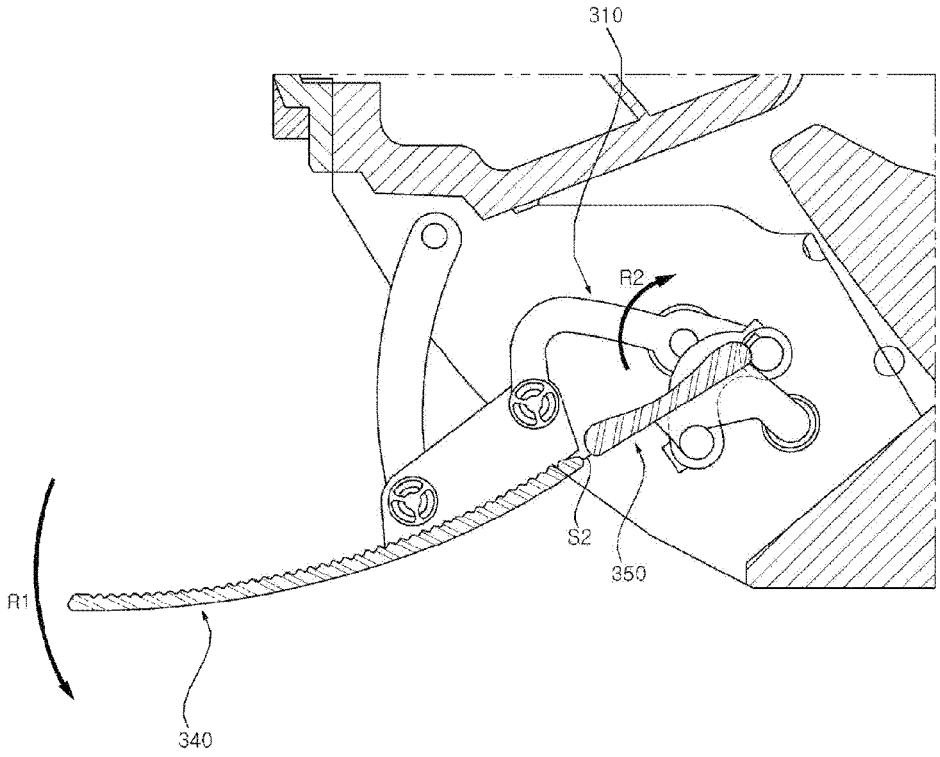
FIG. 4 is a left-side cross-sectional view of positions of dual vanes in a horizontal discharge mode.

The horizontal discharge mode will be described below with reference to FIG. 4.

When operation starts, the vane motor 200 rotates in the second rotation direction R2. The second rotation direction R2 is a clockwise direction with respect to FIG. 4. When the vane motor 200 rotates, the first vane link 320 rotates forward about the 1-2 vane link shaft 323. The front end of the first vane 340, which is located at the upper end of the outlet, moves downward. When the vane motor 200 rotates, the second vane link 330 rotates about the 2-1 vane shaft 332. The front end of the second vane 330 moves downward. When a distance between the rear end of the first vane 340 and the front end of the second vane 350 is a shortest distance, the first vane 340 and the second vane 350 are disposed in a single line, and the horizontal discharge mode for discharging air horizontally is performed.

The vertical discharge mode will be described below with reference to FIG. 2.

In the horizontal discharge mode, the vane motor 200 may rotate further in the second rotation direction R2. When the vane motor 200 rotates, the first vane link 320 rotates rearward about the 1-2 vane link shaft 323. The rear end of the first vane 340 rises to be disposed vertically. When the vane motor 200 rotates, the second vane link 350 further rotates about the 2-1 vane shaft 352 in the same direction, and the front end of the second vane 350 moves downward. When the first vane body 341 and the second vane body 351 are disposed horizontally, the vertical discharge mode for discharging air vertically is performed.

When the vane motor 200 further rotates in the second rotation direction R2 in the vertical discharge mode, the first vane 340 moves to a limit of its rearward movement. When the vane motor 200 further rotates in the second rotation direction R2 in the vertical discharge mode, the rear end of the first vane 340 makes contact with the connection part 316. The connection part 316 acts as a stopper, and a position where the rear end of the first vane 340 makes contact with the connection part 316 corresponds to the limit of its rearward movement or a maximum rotation range.

The vane motor 200 rotates in the first rotation direction R1 opposite the second rotation direction R2 and performs the vertical discharge mode (FIG. 2) and the horizontal discharge mode (FIG. 4), and the first vane 340 closes the outlet 101 (FIG. 5).

While the present disclosure has been particularly shown and described with reference to preferred embodiments thereof, it will be understood by those skilled in the art that the present disclosure is not limited to those exemplary embodiments and various changes in form and details may be made therein without departing from the scope and spirit of the invention as defined by the appended claims and should not be individually understood from the technical spirit or prospect of the present disclosure.

| Explanation of Reference Numerals and Symbols | |
|---|---|
| 100: case | 200: vane motor |
| 300: vane module | 310: drive link |
| 320: first vane link | 330: second vane link |
| 340: first vane | 341: first vane body |
| 342: 1-1 vane shaft | 343: 1-2 vane shaft |
| 344: first vane rib | 345: front end |
| 346: rear end | 347: left end |
| 348: right end | 349: central part |
| 350: second vane | 360: third vane link |
| c1: first curvature | c2: second curvature |
| c3: third curvature | d1: first radius of curvature |
| d2: second radius of curvature | d3: third radius of curvature |
| e1: first center of curvature | e2: second center of curvature |
| e3: third center of curvature | |

The invention claimed is:

1. An indoor unit of an air conditioner, the indoor unit comprising:

a case having an outlet elongated in one direction;

a first vane disposed at the outlet;

a second vane disposed at the outlet at a position behind the first vane;

a drive motor disposed on one side of the outlet and configured to provide a driving force to at least one of the first vane or the second vane;

a drive link coupled to a shaft of the drive motor, and having a first end connected to the first vane and a second end connected to the second vane; and a first vane link having a first end connected to the case and a second end connected to an end portion in a longitudinal direction of the first vane, wherein the first vane has a first curvature formed on an upper surface or a lower surface in the longitudinal direction, and wherein the first vane further has a second curvature with a radius of curvature different from a radius of curvature of the first curvature.

2. The indoor unit of claim 1, wherein the first curvature is concave in an air discharge direction when the first vane closes the outlet.

3. The indoor unit of claim 2, wherein the first curvature is formed such that an upper surface of the first vane is convex upward.

4. The indoor unit of claim 1, wherein the first radius of curvature is shorter than the second radius of curvature.

5. The indoor unit of claim 1, wherein the first vane has a third curvature formed in a direction intersecting a direction in which the first curvature is formed.

6. The indoor unit of claim 5, wherein the third curvature is formed perpendicular to a longitudinal direction of the outlet.

7. The indoor unit of claim 5, wherein the third curvature is convex in the air discharge direction when the first vane closes the outlet.

8. The indoor unit of claim 5, wherein, with respect to the first vane, a center of curvature of the third curvature is located on an opposite side of a center of curvature of the first curvature.

9. The indoor unit of claim 5, wherein the center of curvature of the first curvature is located below the first vane, and the center of curvature of the third curvature is located above the first vane.

10. The indoor unit of claim 1, further comprising a third vane link having a first end connected to the case and a second end connected to the first vane, and located further inward than the first vane link.

11. The indoor unit of claim 10, wherein a connection position between the third vane link and the first vane is above a connection position between the first vane link and the first vane.

12. The indoor unit of claim 10, wherein a connection point between the first vane and the first vane link is spaced apart from a connection point between the first vane and the drive link.

13. The indoor unit of claim 10, wherein a virtual first straight line connecting a front end and a rear end of a left surface or a right surface of the first vane intersects a virtual second straight line connecting a front end and a rear end of a central part of the first vane.

14. The indoor unit of claim 13, wherein the first straight line and the second straight line intersect each other at a rear of the first vane.

15. The indoor unit of claim 10, wherein a distance between the first end and the second end of the third vane link is shorter than a distance between the first end and the second end of the first vane link.

16. An indoor unit of an air conditioner, the indoor unit comprising:

a case having an outlet extending in a first direction;

a first vane disposed at the outlet and extending in the first direction;

a second vane disposed at the outlet at a position behind the first vane;

a drive motor disposed on one side of the outlet and configured to provide a driving force to at least one of the first vane or the second vane;

a drive link coupled to a shaft of the drive motor, and having a first end connected to the first vane and a second end connected to the second vane; and a first vane link having a first end connected to the case and a second end connected to an end portion in the first direction of the first vane, wherein the first vane has a first curvature formed in the first direction, and wherein the first vane further has a second curvature with a radius of curvature different from a radius of curvature of the first curvature.

17. The indoor unit of claim 16, wherein the first vane has a third curvature formed in a direction intersecting a direction in which the first curvature is formed.

18. The indoor unit of claim 16, wherein the first radius of curvature is shorter than the second radius of curvature.

* * * * *